US008453851B2

(12) United States Patent
Ciesick

(10) Patent No.: US 8,453,851 B2
(45) Date of Patent: Jun. 4, 2013

(54) TELESCOPING DISPLAY RACK

(76) Inventor: James M. Ciesick, Cincinnati, OH (US)

( * ) Notice: Subject to any disclaimer, the term of this patent is extended or adjusted under 35 U.S.C. 154(b) by 0 days.

(21) Appl. No.: 13/072,246

(22) Filed: Mar. 25, 2011

(65) Prior Publication Data

US 2011/0210086 A1 Sep. 1, 2011

Related U.S. Application Data

(63) Continuation of application No. 11/358,432, filed on Feb. 21, 2006, now abandoned.

(51) Int. Cl.
*A47F 1/04* (2006.01)

(52) U.S. Cl.
USPC ..... 211/59.3; 211/51; 211/87.01; 211/126.15

(58) Field of Classification Search
USPC ..... 211/59.3, 51, 87.01, 162, 126.15; 312/72, 312/35, 116, 128; 108/6, 60, 61, 102, 137, 108/108
See application file for complete search history.

(56) References Cited

U.S. PATENT DOCUMENTS

| | | | | | |
|---|---|---|---|---|---|
| 1,619,547 | A * | 3/1927 | Snyder | 211/51 |
| 2,110,299 | A * | 3/1938 | Hinkle | 211/59.3 |
| 5,542,552 | A * | 8/1996 | Yablans et al. | 211/59.3 |
| 5,634,564 | A * | 6/1997 | Spamer et al. | 211/59.3 |
| 5,665,304 | A * | 9/1997 | Heinen et al. | 312/71 |
| 5,855,283 | A * | 1/1999 | Johnson | 211/59.3 |
| 6,523,703 | B1 * | 2/2003 | Robertson | 211/59.3 |
| D485,699 | S * | 1/2004 | Mueller et al. | D6/408 |
| 6,691,891 | B2 * | 2/2004 | Maldonado | 221/279 |
| 6,772,889 | B2 * | 8/2004 | Moceri | 211/90.04 |
| 6,886,700 | B2 * | 5/2005 | Nagel | 211/59.3 |
| 7,093,546 | B2 * | 8/2006 | Hardy | 108/60 |
| 2007/0068885 | A1 * | 3/2007 | Busto et al. | 211/59.3 |
| 2007/0175840 | A1 * | 8/2007 | Richter | 211/59.3 |
| 2007/0175845 | A1 * | 8/2007 | Hardy | 211/184 |
| 2008/0142458 | A1 * | 6/2008 | Medcalf | 211/59.3 |

* cited by examiner

*Primary Examiner* — Katherine Mitchell
*Assistant Examiner* — Candace L Bradford
(74) *Attorney, Agent, or Firm* — Miller Canfield Paddock and Stone; John H. Englemann

(57) ABSTRACT

A display rack comprises a display rack comprises a base adapted to be mounted to a wall, wherein the base defines an elongate slot having a retracted end, an extended end opposite the retracted end, a first groove and a second groove, wherein the first groove is positioned between the retracted position and the second groove, and a tray having a fin movable with respect to the slot as the tray slides along the base between a retracted position wherein the fin is generally adjacent the retracted end and remote from the first groove, and an extended position wherein the fin is at the second groove of the elongate slot. The fin preferably extends perpendicular to the elongate slot and the tray is movable to an initial position where the fin is positioned in the first groove. The fin is preferably provided with a first flange with a first width and a second flange with a second width narrower than the first width. The first groove is large enough to allow the fin to pass through, and the second groove is large enough to allow the second flange but not the first flange to pass through.

2 Claims, 7 Drawing Sheets

TELESCOPING DISPLAY RACK

CROSS REFERENCE TO RELATED APPLICATION

This application is a continuation of U.S. application Ser. No. 11/358,432 filed on Feb. 21, 2006.

FIELD OF THE INVENTION

The present invention relates to improvements in display racks which can display a variety of products. More particularly, the invention pertains to a telescoping display rack for holding and displaying products.

BACKGROUND OF THE INVENTION

In the grocery industry, product displays are constructed to enhance the visibility of the product. It is important that products in the grocery stores remain "faced." "Faced" is a term used to mean that the product is in the front portion of the display case or shelf With products such as paper towels, cereal, and other dry goods, employees of the store manually face the products. Some display racks are self-facing, meaning that, as long as there is more product in the rack, the products remain faced and are not in need of manual facing. For example, beverage racks generally are self-facing using gravity to move the bottles or cans to the front of the display.

One known display rack currently in use is a peg system. A peg is anchored to the rear of a refrigerated case or display case. The package containing the product to be displayed must have a hole in the upper portion of the package. The hole in the package enables the package to slide through the peg and hang therefrom. The peg system, however, is not self-facing. Additionally, in order to rotate the product, the older product must be removed prior to placing the new product on the peg. Other known display technologies in use include shelving that, while removable, is not adjustable. Generally, these devices have fixed widths and products share space on the shelf. A desirable product display would be one that is self-facing and provides the flexibility of having multiple shelves in a single display case, while at the same time, making it easy to rotate the product displayed thereon.

SUMMARY OF THE INVENTION

In accordance with a first aspect, a display rack comprises a base adapted to be mounted to a wall, wherein the base defines an elongate slot having a retracted end, an extended end opposite the retracted end, a first groove and a second groove, wherein the first groove is positioned between the retracted position and the second groove, and a tray having a fin movable with respect to the slot as the tray slides along the base between a retracted position wherein the fin is generally adjacent the retracted end and remote from the first groove, and an extended position wherein the fin is at the second groove of the elongate slot. In accordance with another aspect the fin extends perpendicular to the elongate slot and the tray is movable to an initial position where the fin is positioned in the first groove.

In accordance with another aspect, the fin has a first flange with a first width and a second flange with a second width narrower than the first width. The first groove is large enough to allow the fin to pass through, and the second groove is large enough to allow the second flange but not the first flange to pass through.

From the foregoing disclosure and the following more detailed description of various preferred embodiments it will be apparent to those skilled in the art that the present invention provides a significant advance in the technology of product display racks. Particularly significant in this regard is the potential the invention affords for providing a high quality, low cost telescoping display rack which is easy to restock. Additional features and advantages of various preferred embodiments will be better understood in view of the detailed description provided below.

Figure 1:
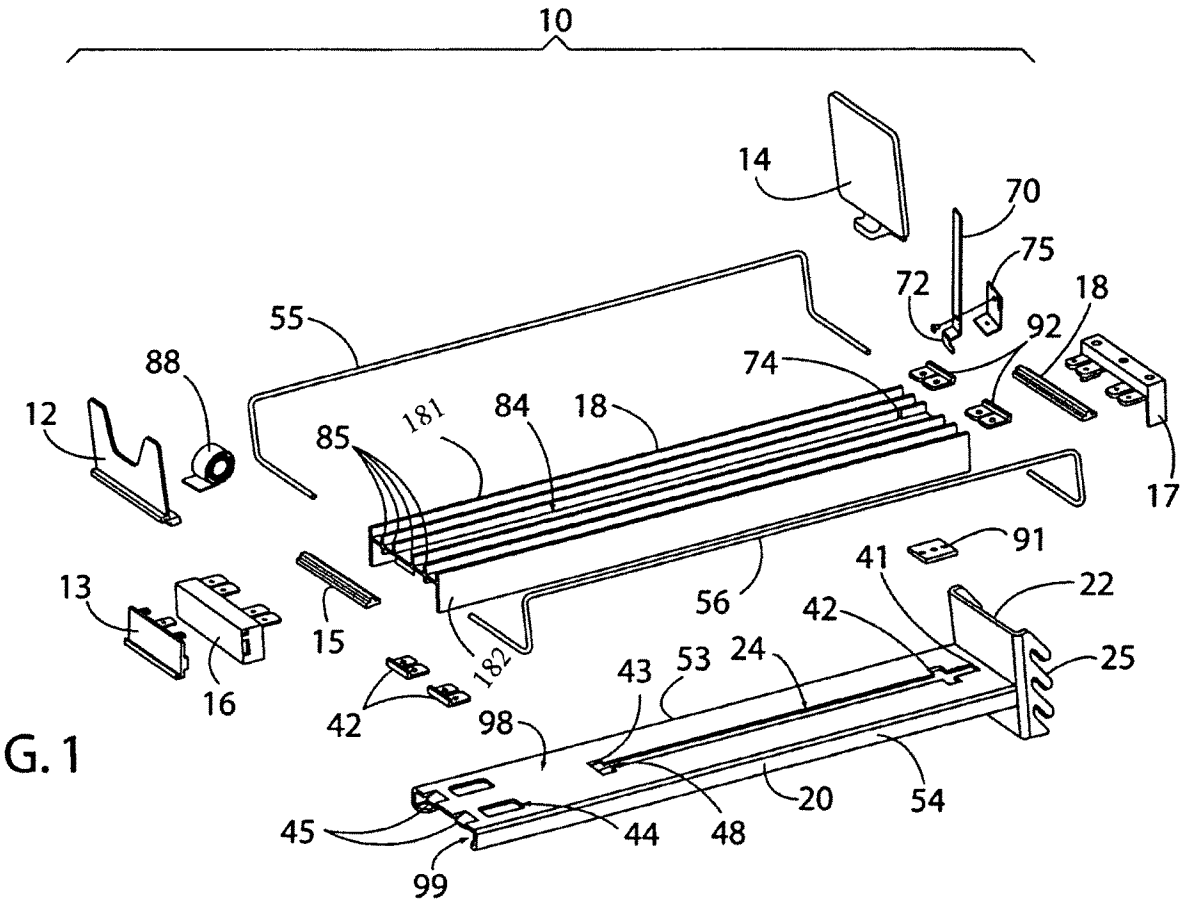
FIG. 1 is an exploded perspective view showing a telescoping display rack in accordance with a preferred embodiment, having a tray and a base.

It should be understood that the appended drawings are not necessarily to scale, presenting a somewhat simplified representation of various preferred features illustrative of the basic principles of the invention. The specific design features of the display rack as disclosed here will be determined in part by the particular intended application and use environment. Certain features of the illustrated embodiments have been enlarged or distorted relative to others to enhance visualization and clear understanding. In particular, thin features may be thickened, for example, for clarity of illustration. All references to direction and position, unless otherwise indicated, refer to the orientation illustrated in the drawings.

DETAILED DESCRIPTION OF THE PREFERRED EMBODIMENTS

It will be apparent to those skilled in the art, that is, to those who have knowledge or experience in this area of technology, that many uses and design variations are possible for the telescoping display rack disclosed here. The following detailed discussion of various alternative and preferred features and embodiments will illustrate the general principles of the invention with reference to a telescoping display rack particularly suitable for use with products such as lunchmeat and related deli products. Other embodiments suitable for other applications will be apparent to those skilled in the art given the benefit of this disclosure.

Turning now to the drawings, FIG. 1 shows an exploded perspective view of a telescoping display rack 10 in accordance with a preferred embodiment. A tray 18 is slidable over a base 20. The tray 18 is slidable between an extended position and a retracted position. The base 20 as shown preferably has a mounting bracket 22 at one end. The mounting bracket 22 has a series of projections 25 adapted to engage wall-mounted supports to mount the display rack. The base has a top side 98 and a bottom side 99, and has downwardly extending flanges 53, 54 which extend downward from the bottom side and provide enhanced strength for the base.

The base 20 is generally rectangular in shape and preferably about the same shape and length as the tray 18. In addition to the mounting bracket 22, the base is provided with an elongate slot 24 having a retracted end 41 and an extended end 48. The slot has a first groove 42 and a second groove 43. Both grooves are preferably generally perpendicular to the elongate slot. The first groove 42 is close to but not at the retracted end 41. The second groove 43 is preferably positioned at the extended end 48. The base 20 is also provided with a pair of openings 44 and a pair of corresponding ramped surfaces 45. These openings 44 and ramps 45 cooperate with corresponding teeth 28 on the tray 18 (shown in FIGS. 3 and 5) to help with assembling the tray to the base.

The tray 18 as shown is a generally elongate member optionally provided with a series of ribs 85 running parallel to the direction of motion of the tray (with respect to the base 20) as the tray moves from the extended position to the retracted position. A pair of side rails 55, 56 may be attached to the sides 181, 182 of the tray 18, extending above the tray 18 and being substantially parallel to both a longitudinal axis of the tray 18 and to the ribs 85. In use, the side rails 55, 56 help keep the products being displayed on the tray from falling over one of the sides 181, 182 while still allowing easy access to the product. In accordance with a preferred embodiment, the side rails 55, 56 are adjustable in order to accommodate products of various widths.

The tray 18 may also have a front cap 16 and a rear cap 17, each operatively connected to an end of the tray 18 with brackets 42, 92, respectively. The front cap 16 cooperates with a protector 15 and in a similar manner the rear cap 17 cooperates with a protector 18 to help secure the side rails 55, 56 to the tray and to cover the ends of the tray. The front cap 16 provides a barrier to limit travel of a pusher 14 (described in greater detail below) to a forward position. The rear cap 17 optionally can limit travel of the tray 18 with respect to the base 20, defining a retracted position when the rear cap contacts mounting bracket 25. Optionally a name plate cover or price channel 13 and a frame piece 12 may be mounted with the tray, such that a conventional price card may be attached thereto.

Figure 8:
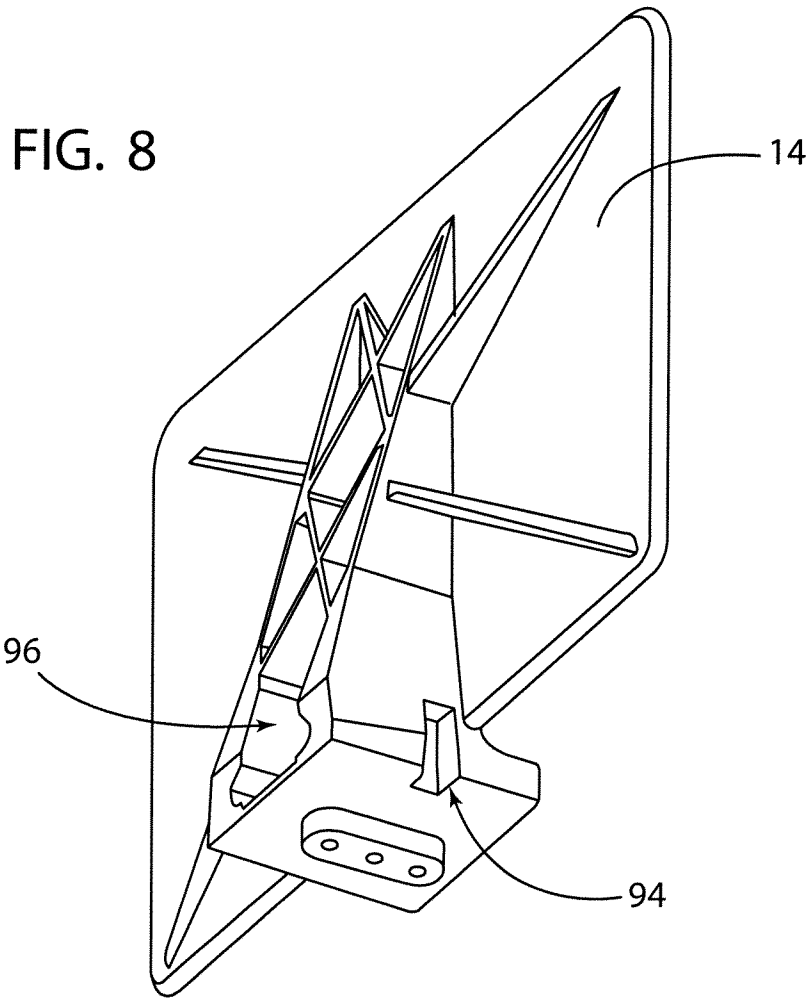
FIG. 8 is an isolated perspective view of the pusher, including a pusher pocket adapted to receive a lock to lock the pusher.

As can be seen in the Figs., the invention may also include a product pusher 14 that may be substantially the same width as the tray. The pusher is operatively connected to a pusher block 91 through a slot 84 in the tray. The pusher 14 slides in a bi-directional manner along a length of travel defined by the slot 84 in the tray. In accordance with a preferred embodiment, the pusher is biased to the forward position. As shown in the drawings, the biasing device can be, for example, a spring 88 mounted on the front cap 16 at one end and to the pusher at 96, shown in FIG. 8. In use, the product pusher 14 pushes the products that are positioned on the tray 18 toward one end of the tray. As products are removed from the one end of the tray, the remaining products are automatically pushed forward, i.e., the products self face.

Figure 2:
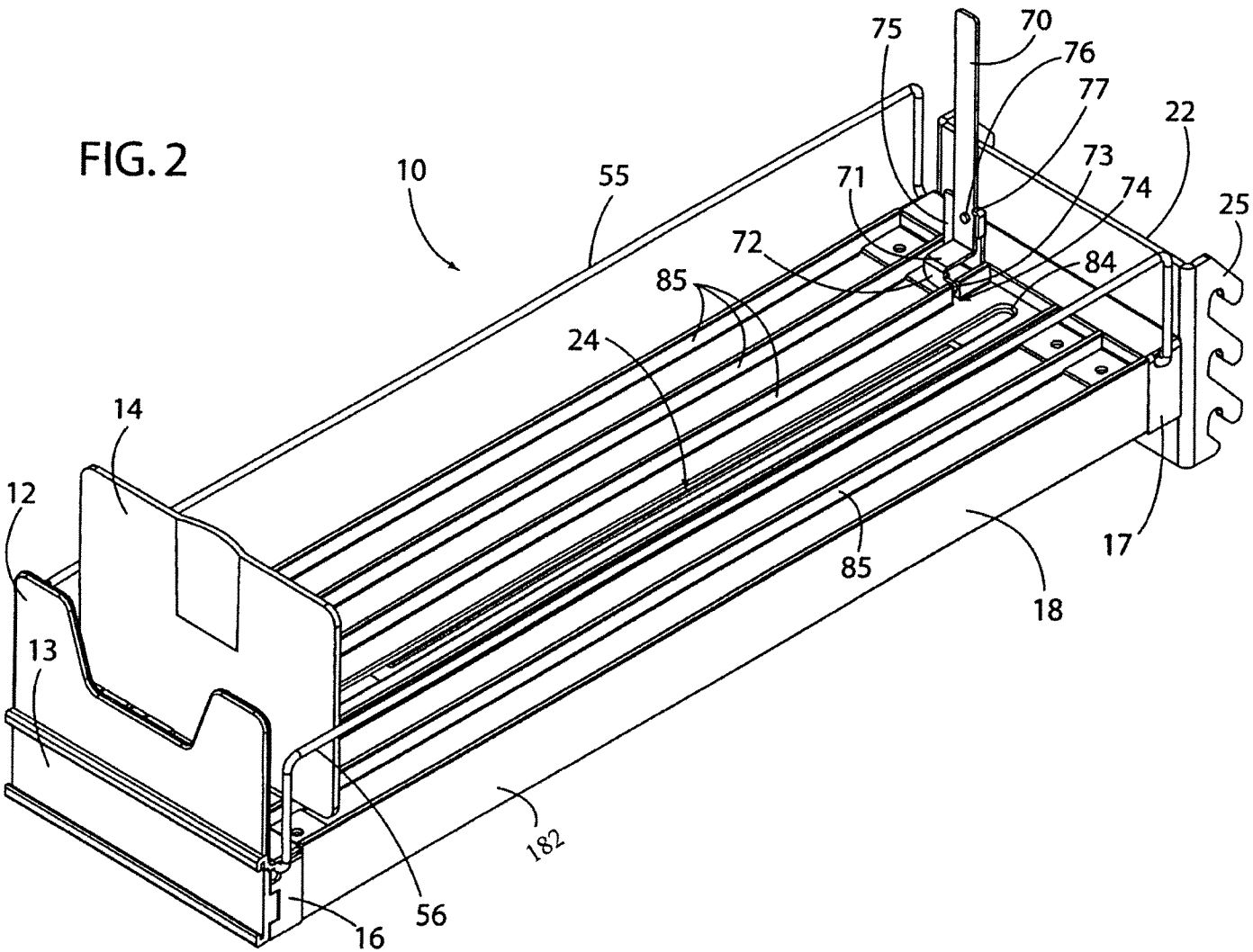
FIG. 2 is a perspective view of the telescoping display rack in accordance with a preferred embodiment, shown in a retracted position.
Figure 7:
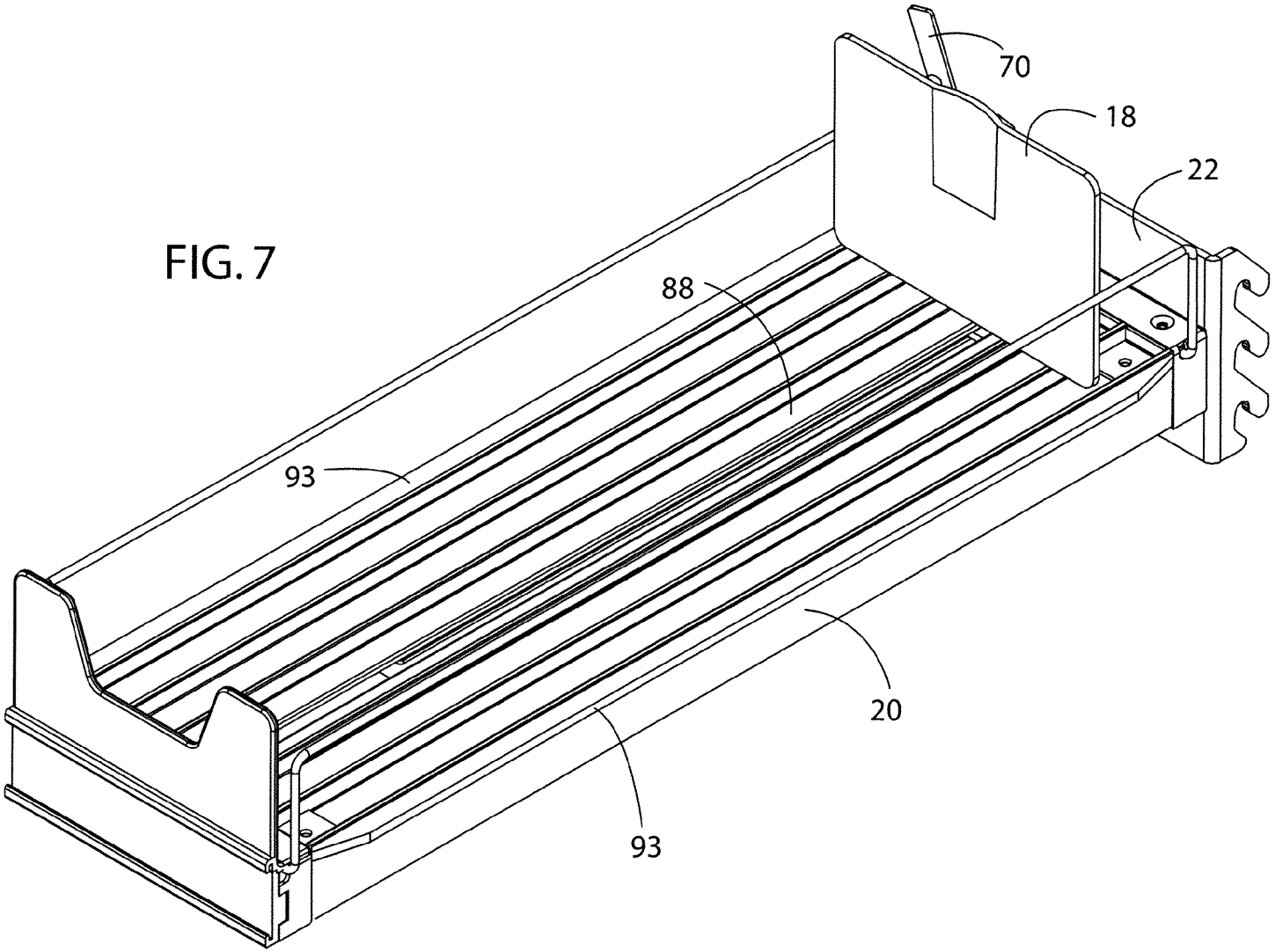
FIG. 7 is a perspective view analogous to FIG. 1, but showing a pusher in a locked position and showing optional bumpers formed as unitary extensions of the tray.

Preferably the pusher can be held in a locked position with respect to the tray 18. In accordance with a preferred embodiment, a lever lock 70 is used to hold the pusher 14 in the locked position. This feature advantageously helps a user with restocking. With the pusher in the locked position, the user does not have to overcome the force of the spring 88 to insert new products. The lever lock 70, as best shown in FIG. 2, is mounted on a mounting bracket 75 with pivot 76. A toe 73 is connected via shoe 72 and flange 71. The toe 72 is shown in FIG. 2 sitting in a gap 74 in one of the ridges 85. The lever abuts against flange 77 of the mounting bracket, resisting further rotation of the lever lock. The lever lock can pivot so that the toe extends past the gap 74. In operation, the pusher 14 is pushed, uncoiling the spring 88, until the pusher reaches the lever lock 70. The lever lock is pivoted until it enters pusher pocket 94, holding the pusher while the spring is uncoiled (see FIG. 7). FIG. 7 also shows another optional feature: bumpers 93 formed as sloped, curved unitary extensions of tray 18. Preferably the bumpers extend beyond the width of the side rails 55, 56, protecting the side rails from contact with other racks.

Figure 3:
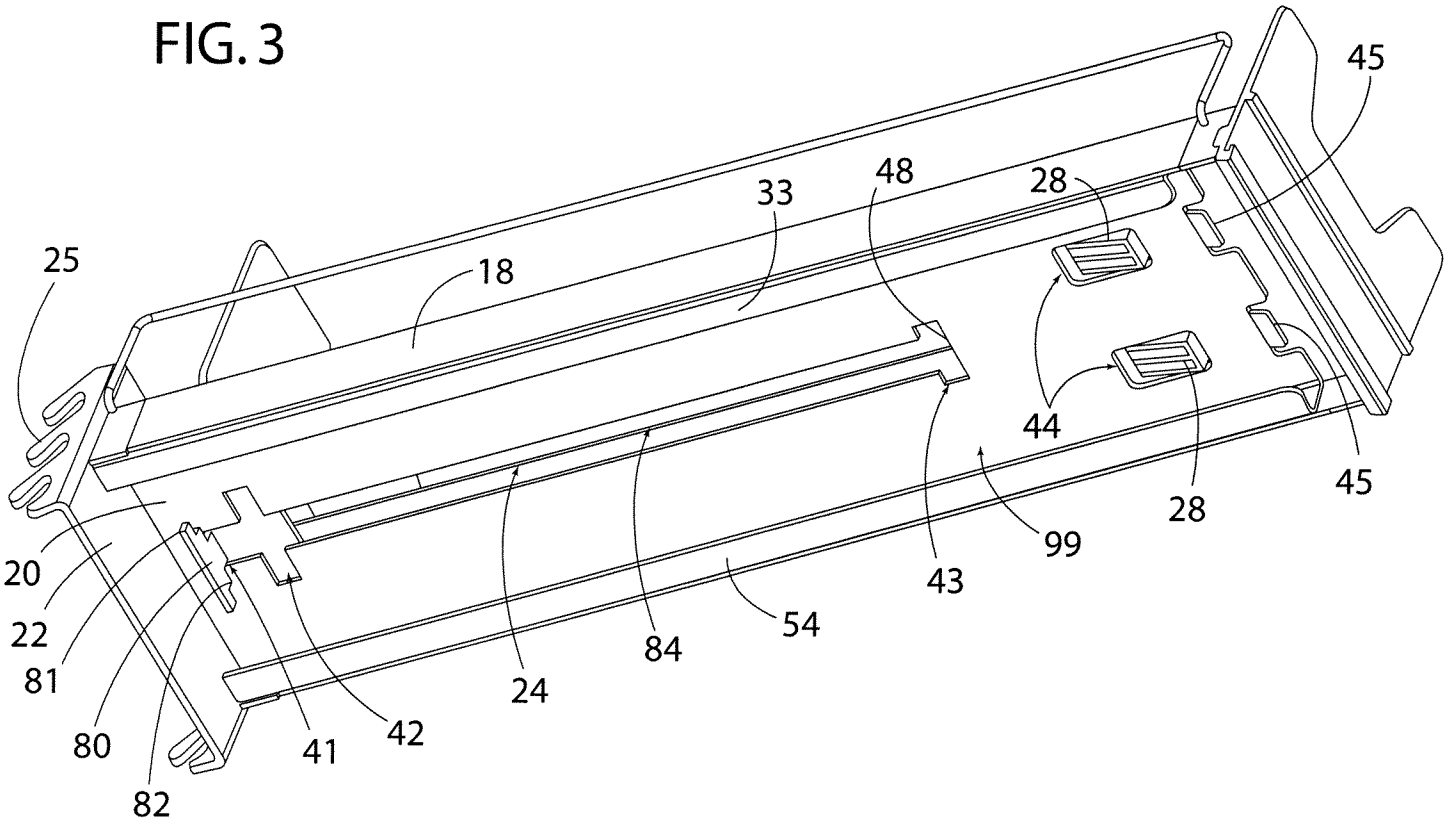
FIG. 3 is a perspective view of the telescoping display rack of FIG. 1, shown in a retracted position from the underside with teeth of a tray engaging corresponding openings in a base.
Figure 5:
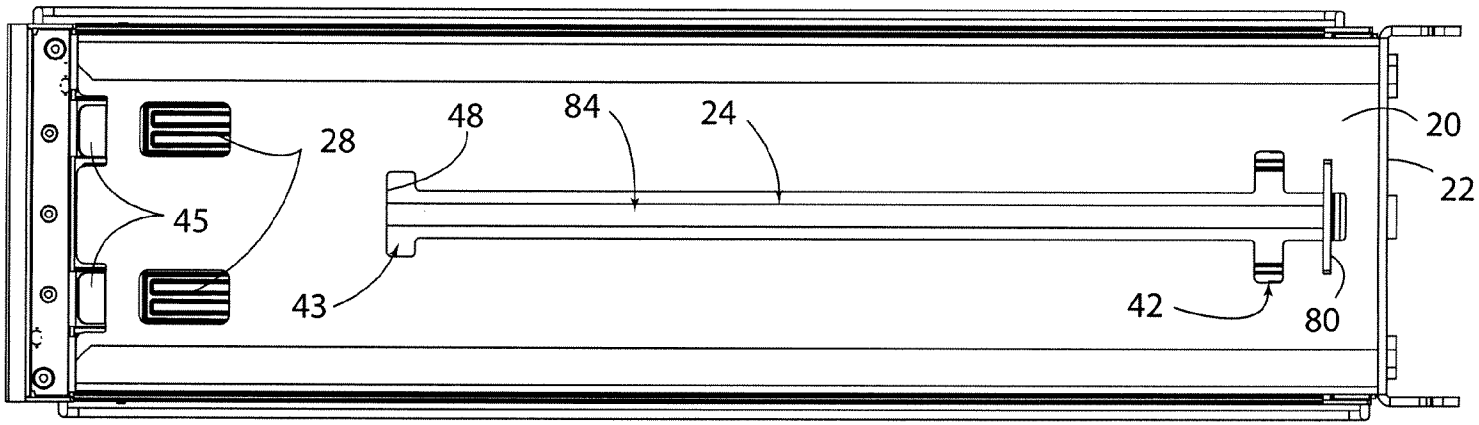
Figure 6:
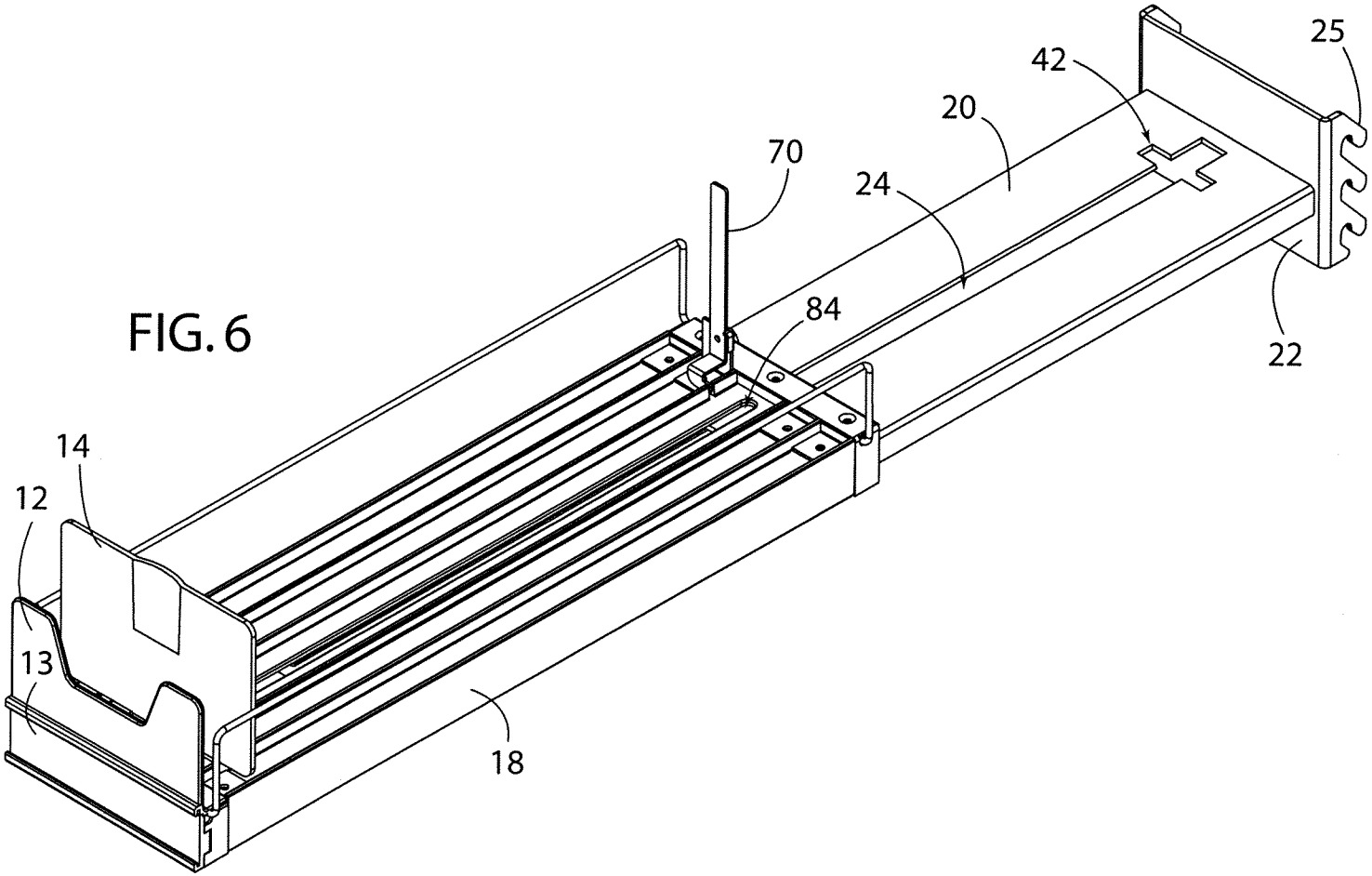
FIG. 6 is a perspective view of the telescoping display rack of FIG. 1, shown in an extended position.

The tray 18 is slidable over the top side 98 of the base 20 between a retracted position and an extended position. FIGS. 2-5 show the display rack 10 in the normal retracted position. FIG. 6 shows the display rack in the extended position. FIGS. 3 and 5 show a fin 80 mounted on the tray 18. Fin 80 may be, for example, formed as part of rear cap 17. In accordance with a highly advantageous feature, the fin 80 mounted on the tray engages the elongate slot 24, thereby slidably captivating the tray 18 to the base. As best shown in FIG. 3, the fin can be operatively connected to the tray 18 so that as the tray slides over the top side 98 of the base 20, the fin 80 slides under the bottom side 99 of the base. Preferably the fin 80 is a planar member positioned generally perpendicular to the elongate slot 24 having neck 83 operatively connecting the fin 80 to the tray 17. The fin has a first flange 81 having a first width and a second flange 82 having a second width less than the first width. The first groove 42 of the base is large enough to allow the first flange 81 of the fin 80 to pass through, and the second groove 43 is large enough to allow the second flange 82 but not the first flange 81 to pass through The elongate slot has a width 57, the first groove 42 has a first groove width 58, and the second groove has a second groove width 59 such that the first groove width 58 is greater than the second groove width 59 and wider than the first flange 81. The second groove width 59 is greater than the elongate slot width 57 and wider than the second flange 82, but narrower than the first flange 81. The neck 83 of the fin is narrower than the elongate slot width 57.

Figure 4:
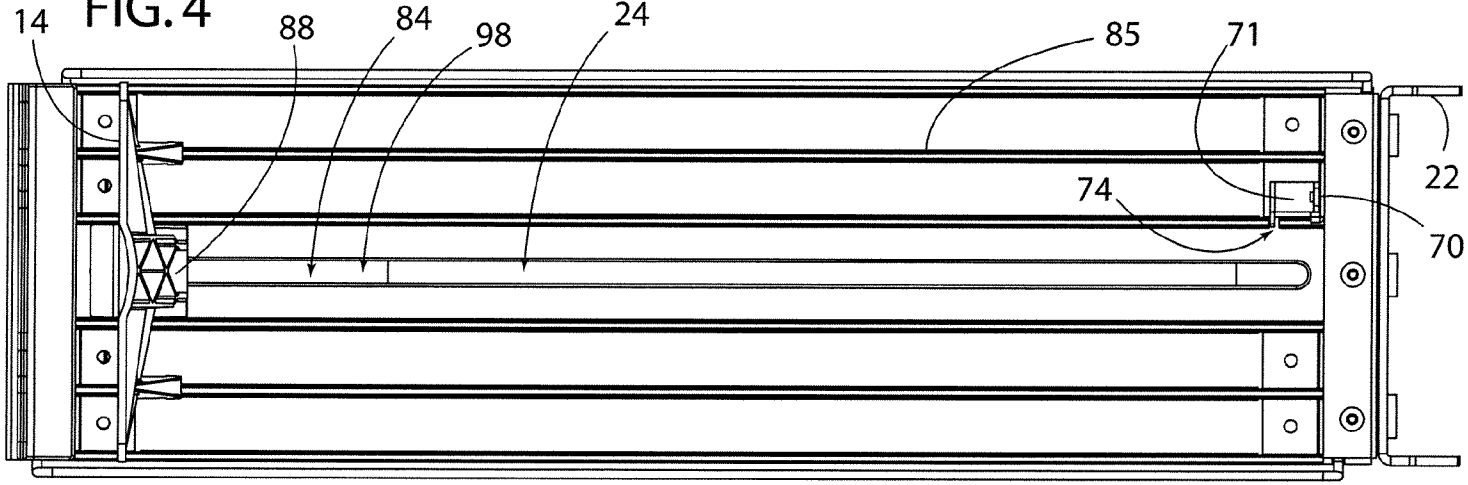
FIGS. 4 and 5 are top and bottom views of the telescoping display rack of FIG. 1, shown assembled and in the retracted position.

FIG. 4 shows both the tray slot 84 and the elongate slot 24. Preferably the elongate slot 24 is aligned under the tray slot. The travel of the tray 18 with respect to the base is limited at one end by contact of the end cap 17 with the bracket 25 and at the other end by the fin contacting the extended end 48 of the elongate slot 24 of the base.

FIGS. 3 and 5 show teeth 28 engaging the base at openings 44. Preferably the teeth 28 are provided with a slope which generally corresponds to a slop of the ramps 45. During initial connection of the tray to the base, the teeth slide over the ramps along the top side of the base, and then drop into the openings 44. Once in the openings 44, the teeth help restrict movement of the tray with respect to the base.

In accordance with a highly advantageous feature, the tray 18 is slidable along the elongate slot between one of several positions. These positions comprise: an initial position, the retracted position, and the extended position. Connection of the tray to the base is accomplished by sliding the tray over the top side of the base. The teeth 28 slide up the ramps 45, and the fin 80 drops into the elongate slot 24 at first groove 42. The initial position is therefore defined as where the fin 80 is directly underneath the first groove 42. Note at this position, the teeth are not in the openings 44 and the tray is angled somewhat with respect to the base. The teeth 28 engage the openings 44 at the retracted position, (shown in FIGS. 2-5 and 7) where the fin is near or at the retracted end 41 of the elongate slot 24. As shown in the Figs., the fin 80 does not reach the retracted end 41; rather the fin 80 is positioned generally adjacent the retracted end 41 and remote from the first groove 42. The teeth 28 engage the openings 44 helping to resist lateral displacement of the tray with respect to the base, and help resist movement of the tray toward the extended position. The width of both the first flange 81 and second flange 82 is sufficient to resist vertical dislocation of the tray with respect to the base. Retracted position is the normal position for the display rack. The pusher 14 may be unlocked or locked independent of tray position.

Before the tray can be slid along the elongate slot 24 to the extended position (shown in FIG. 6), the tray must be lifted slightly from the retracted position so that the teeth 28 can disengage the openings 44. In the extended position, the fin 80 moves to the second groove 43, located at the extended end 48 of the elongate slot 24. The first width 81 of the fin 80 is sufficient to prevent passage through the second groove 43. Optionally, however, even if the fin is too large to pass through the second groove, the second flange 82 may be sufficiently small to pass through the second groove 43. The effect of this is a slight tipping of the tray 18 with respect to the base 20, making it more difficult to move the tray since the second flange width is wider than the elongate slot 24.

The display rack 10 disclosed here can be mounted in the rear of a refrigerated display case or on the rear of a conventional shelf, and can be particularly suited to display food products that are sensitive to spoilage. For example, the display rack may be mounted to a refrigerated case for prepackaged deli meats, or in a non-refrigerated environment to display, for example, baby jars. Advantageously, the display rack 10 disclosed herein is designed to lower operational expenses associated with the labor cost of restocking shelves. The display rack 10 can be attached to a conventional wire rack containing a plurality of spaced, horizontally oriented wires or supports (not shown). The rack can be located, for example, in the rear of a refrigerated display case or on the rear of a conventional shelving system. A further advantage of the display rack disclosed herein is that groups of such racks may be used together, allowing for efficient, orderly and aesthetically pleasing display of product.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A display rack comprising, in combination:

a base adapted to be mounted to a wall, wherein the base defines an elongate slot having a retracted end, an extended end opposite the retracted end, and a first groove, wherein the first groove is positioned between the retracted end and the extended end and the first groove extends perpendicular to and is bisected by the elongate slot; a tray slidably releasably captivated to the base, comprising a fin movable with respect to the slot as the tray slides along the base between a retracted position wherein the fin is generally adjacent the retracted end and remote from the first groove, and an extended position wherein the fin is at a second groove extending perpendicular to and is bisected by the elongate slot; and a pusher slidable along the tray and a lever lock, wherein the lever lock is movable to a locking position where the lever lock holds the pusher in place with respect to the tray; wherein the lever lock is insertable into a pusher pocket of the pusher, the tray has a ridge running parallel to the direction, of slidable motion of the tray with respect to the base, and a gap in the ridge permits the lever lock to move to access the pusher pocket and lock the pusher with respect to the tray, wherein the fin has a first flange with a first width wider than the second groove such that when the tray is at the extended position the fin is at a second groove, and the fin cannot pass completely through the second groove; wherein the fin further comprises a second flange having a second width which can pass through the second groove; and wherein movement of the second flange through the second groove allows the tray to tip relative to the base.

2. A display rack comprising, in combination:

a base having a top and a bottom, adapted to be mounted to a wall, wherein the base defines an elongate slot having a retracted end and an extended end opposite the retracted end, and a first groove and a second groove, each groove extending perpendicular to and bisected by the elongate slot; and a tray slidable along the top of the base, comprising a fin extending into the elongate slot from the top through the base to the bottom, the fin having a first flange with a first width and a second flange with a second width narrower than the first width; wherein the first flange of the fin can pass from the bottom of the base to the top of the base at the first groove, and the second groove is large enough to allow the second flange but not the first flange to pass through the base; wherein movement of the second flange through the second groove allows the tray to tip relative to the base.

* * * * *